United States Patent [19]

Selivanov et al.

[11] 4,053,000

[45] Oct. 11, 1977

[54] SHEDDING MECHANISM FOR TRAVELLING-WAVE LOOMS

[76] Inventors: Anatoly Grigorievich Selivanov, Donskaya ulitsa, 24, kv. 110; Gennady Ivanovich Kovalev, Kronshtadsky bulvar, 27, kv. 85, both of Moscow, U.S.S.R.

[21] Appl. No.: 682,391

[22] Filed: May 3, 1976

[51] Int. Cl.[2] ..... D03D 47/26

[52] U.S. Cl. ..... 139/436

[58] Field of Search ..... 139/436, 13, 55

[56] References Cited

U.S. PATENT DOCUMENTS

| | | | |
|---|---|---|---|
| 1,161,979 | 11/1915 | Salisbury | 139/436 |
| 3,640,314 | 2/1972 | Strauss | 139/436 |
| 3,831,638 | 8/1974 | Selivanov et al. | 139/436 |

FOREIGN PATENT DOCUMENTS

| | | | |
|---|---|---|---|
| 1,394,838 | 5/1975 | United Kingdom | 139/436 |

*Primary Examiner*—Henry S. Jaudon

*Attorney, Agent, or Firm*—Steinberg & Blake

[57] ABSTRACT

The present invention relates to shedding mechanisms most advantageously used on wide travelling-wave looms. These mechanisms comprise systems of heddle shafts and cams rigidly secured on a drive shaft, imparting to the heddle shafts dephased motion and arranged in groups in a housing so that individual drive sections are formed, additional heddle shafts coupled with the cophasal main heddle shafts being installed therebetween. Such an arrangement enables the loom width to be more fully utilized, wide fabrics to be woven and the width of the fabric produced to be varied.

7 Claims, 11 Drawing Figures

HEDDLE SHAFT DRIVE
HEDDLE SHAFT DRIVE

SHEDDING MECHANISM FOR TRAVELLING-WAVE LOOMS

The present invention relates to travelling-wave looms and, more particularly, it relates to shedding mechanisms used on these looms.

Most advantageously the present invention can be realized on wide travelling-wave looms producing fabrics of various weaves from various kinds of fibres.

At present, there are known shedding mechanisms for travelling-wave looms, wherein the motion to the heddle shafts is transmitted by coupling elements from rotatable cams arranged across the loom width. Such shedding mechanisms may be one-piece or made up of a plurality of sections including therewithin drive elements imparting motion to the heddle shafts. Most effective are wide travelling-wave looms with a weaving width of 330 to 450 cm. At such a weaving width, it is less laborious and more convenient, as regards both fitting-up and servicing, to employ a shedding mechanism including a system of heddle shafts with heddles for passing the warp ends and cams. These cams rigidly secured on a drive shaft with a shift phase relative to one another for imparting dephased motion to the heddle shafts are located in groups in a housing, whereby individual drive sections are formed. In the spacings between the drive sections, there are formed so-called dead zones, i.e. the zones wherein neither the cams nor the elements coupling the latter with the heddle shafts, nor the heddle shafts proper can be located. Owing to this, the weaving width cannot be fully utilized, wide fabrics cannot be woven, and the number and width of the fabrics being produced at the same time cannot be arbitrarily varied.

The principal object of the present invention is to provide a shedding mechanism for travelling-wave looms, wherein a system of heddle shafts and drive sections thereof will enable the loom width to be more reasonably and fully utilized, a wide fabric to be produced and the width of the fabric produced to be varied.

This object is attained in that in a shedding mechanism for travelling-wave looms comprising systems of heddle shafts with heddles for passing the warp ends and cams rigidly secured on a drive shaft, imparting dephased motion to the heddle shafts for the travelling-wave shed to be formed and arranged in groups in a housing, thereby making up individual drive sections, in accordance with the present invention, included in the system of the heddle shafts are additional heddle stakes installed at least at one portion corresponding to the spacing between the drive sections and coupled with the cophasal main heddle shafts.

Employment of such a mechanism makes it possible to arrange the heddle shafts across the entire weaving width of the loom and to produce a wide fabric. Should the necessity arise to weave several narrow fabrics at the same time, selvage motions must be installed between the split ups.

In accordance with the invention, the coupling of the additional heddle shafts with the cophasal main heddle stakes is accomplished by means of rods rigidly coupled therewith. Such a coupling is the simplest, yet fairly dependable one.

Since the main and additional heddle shafts move somewhat out of phase, this fact should be taken into account. Accordingly, the additional heddle shafts are coupled with the cophasal main heddle shafts through the medium of links articulated therewith.

Also in accordance with the invention, each additional heddle stake is coupled with two cophasal main heddle shafts. The additional heddle shafts are installed at all portions corresponding to the spacings between the drive sections. Such an arrangement makes it possible to produce a wide fabric.

Given below is a detailed description of the present invention with reference to the accompanying drawings, wherein.

Figures 1, 2:
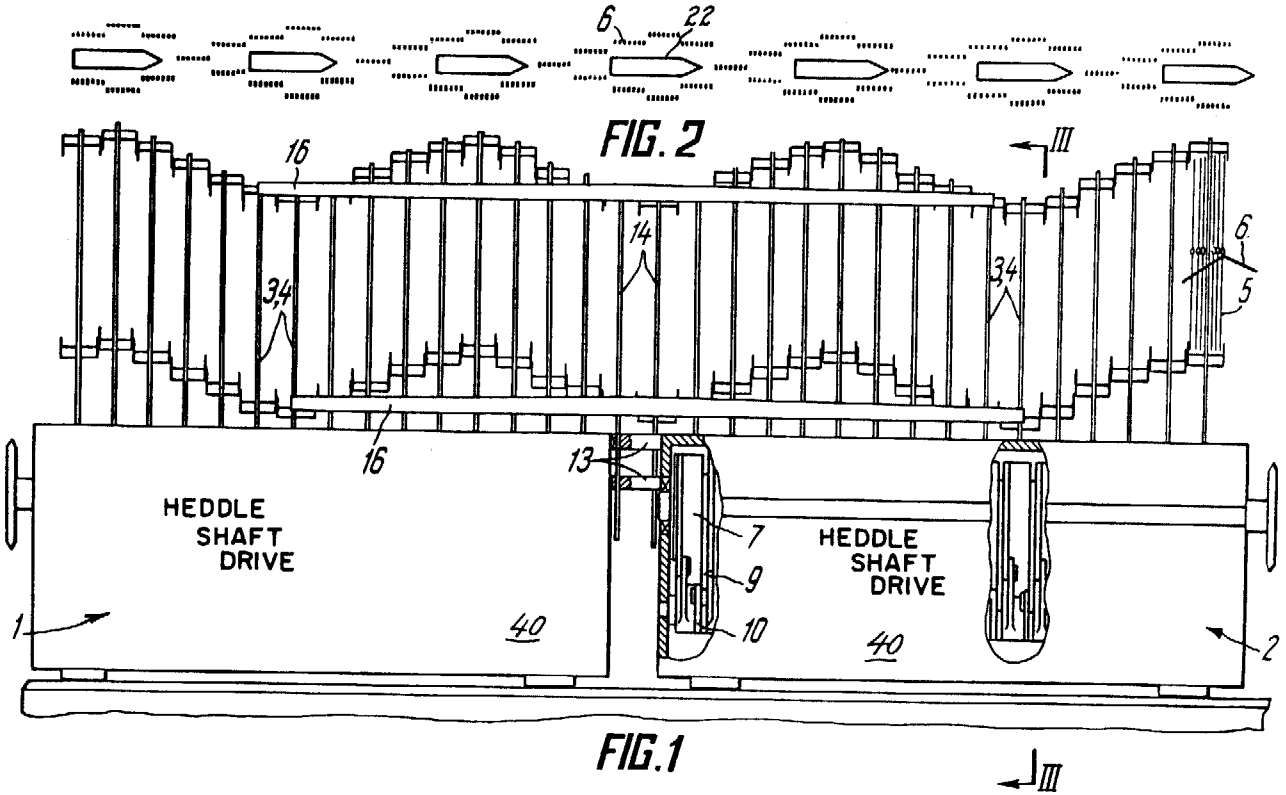
FIG. 1 is a front view of a shedding mechanism according to the invention, (for the sake of clarity only the drive of the additional heddle shafts of the first row is shown)
FIG. 2 is a cross-sectional view of a travelling-wave shed with weft carrier.

The herein disclosed shedding mechanism comprises several heddle-shaft drive means or sections, for instance, two sections 1 and 2 (FIG. 1). Each section or drive means forms part of a loom for weaving a fabric of a given width and serves to drive two systems of heddle shafts 3 and 4 with heddles 5 adapted to admit warp ends 6 (FIG. 2) and cams 7 (FIG. 3) rigidly secured on a drive shaft 8. These cams are installed on the shaft with a phase shift relative to one another for imparting flat-parallel alternate movement to the heddle shafts 3, 4, whereby a travelling-wave shed is formed in a well known manner. This movement is transmitted to the heddle stakes by the cams 7 through collars 9 seated on peripheries of the cams 7, levers 10 installed on a stationary shafts 11 with a freedom to rock thereabout, and connecting rods 12. The drive means as well as a guide for lower portions of the heddle shafts 3 and 4 are situated in a housing 40, as is apparent from FIGS. 1 and 3.

Figure 4:
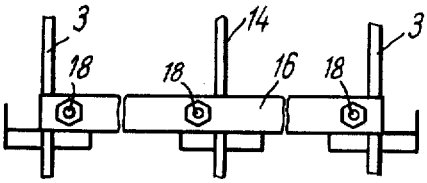
FIG. 4 is a front view of an embodiment having rigid coupling of a rod with heddle shafts.
Figure 6:
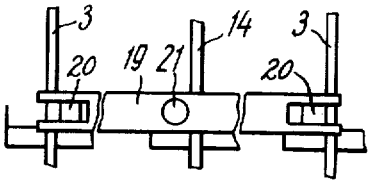
FIG. 6 is a front view of another embodiment showing an articulated coupling of a link with heddle shafts.
Figure 5:
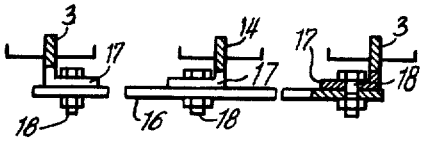
FIG. 5 is a top view of FIG. 4.
Figure 7:
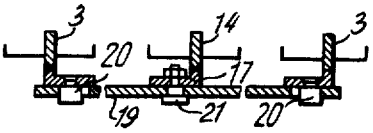
FIG. 7 is a top view of FIG. 5.
Figure 8:
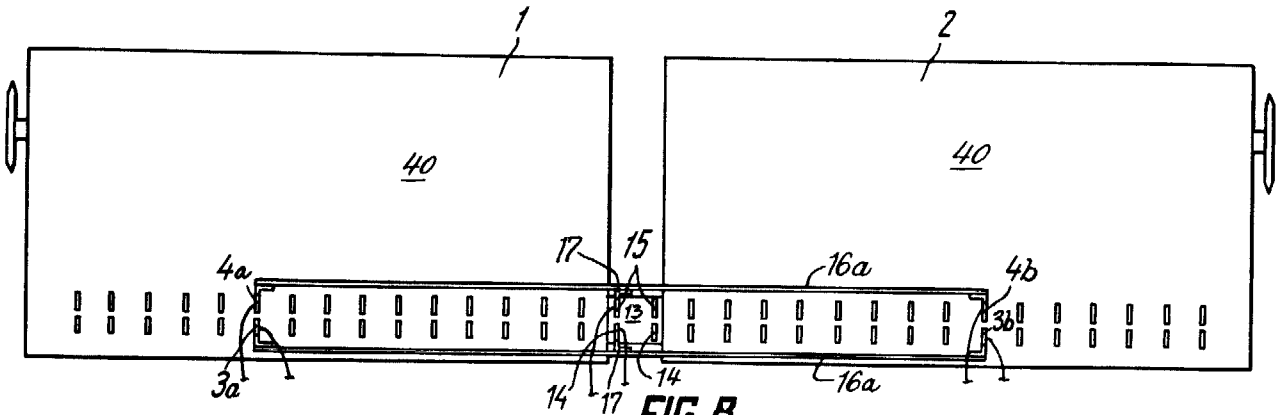
FIG. 8 is a top plan view of the structure of FIG. 1.
Figure 10:
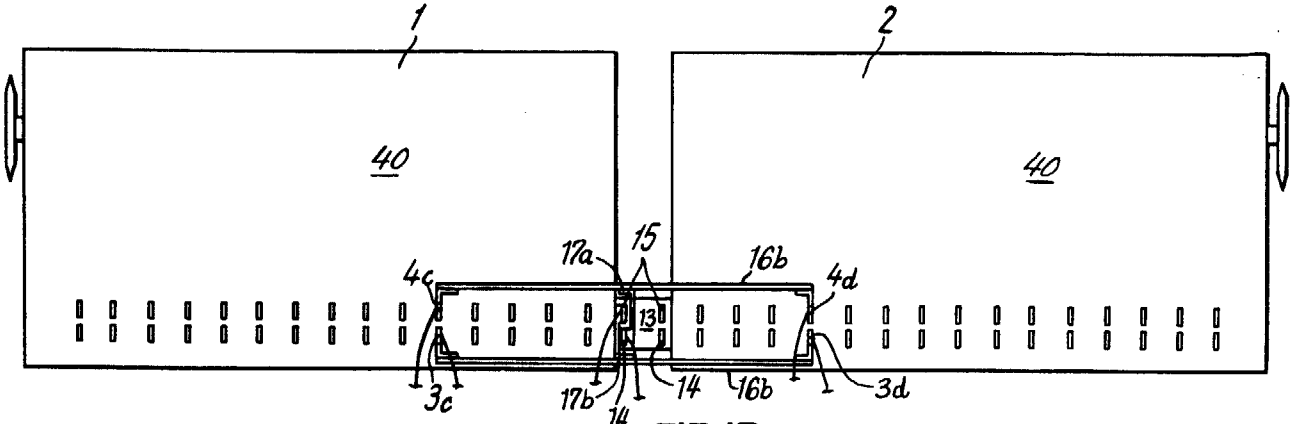
FIG. 10 is a top view of the shedding mechanism, according to the invention, illustrating another embodiment.

Installed between the sections 1 and 2 (FIG. 1) in guideways 13, fixed to and extending between housings 40 as shown in FIGS. 1, 8, and 10, are additional heddle shafts 14, 15 coupled with the cophasal main heddle shafts. This coupling is accomplished by means of rods 16 (FIG. 4). The rods are rigidly coupled with the additional heddle shafts 14 and the main stakes 3 via angles 17 soldered to the shafts 14 and 3 and bolts 18 (FIG. 5). However, the additional and main heddle shafts may be coupled by means of a link 19 (FIG. 6) the slotted or forked ends of which are adapted to receive blocks 20 (FIG. 7) secured rotatably on angles 17 of the main heddle shafts 3. The link proper is secured by means of a hinge 21 (FIG. 6) on the additional stake 14.

Figure 3:
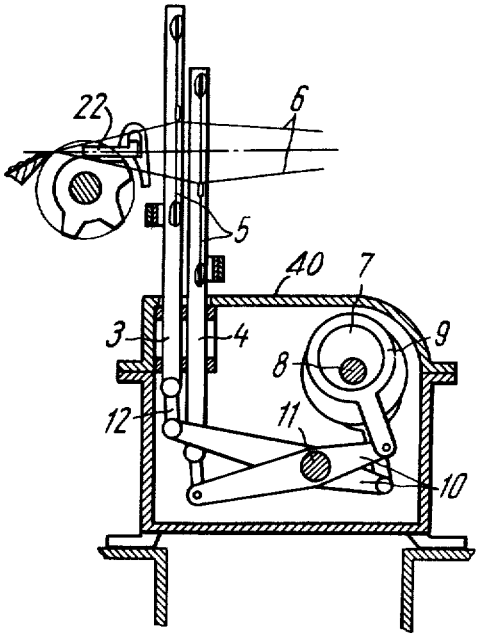
FIG. 3 is a section along line III—III of FIG. 1.
Figure 9:
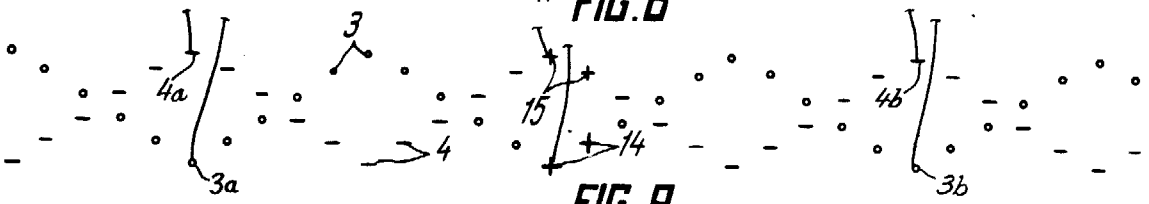
FIG. 9 shows schematically one of the positions of the heddle shafts of the shedding mechanism of FIG. 8.
Figure 11:
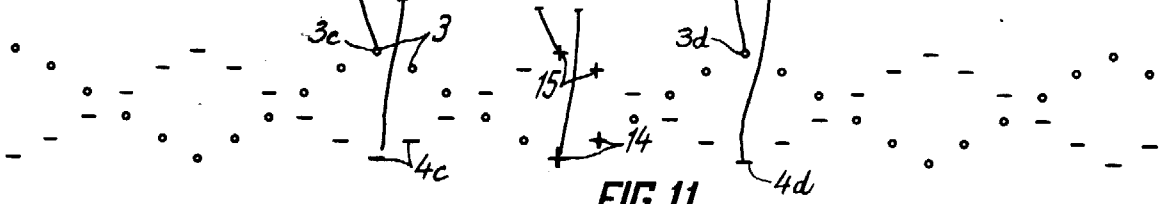
FIG. 11 shows schematically one of the positions of the heddle shafts of the shedding mechanism of FIG. 10.

The additional heddle shafts may be coupled through the rod either with respective main heddle shafts of the same heddle system as is shown in FIGS. 8 and 9 or with respective main heddle shafts of the other heddle system as is shown in FIGS. 10, 11. In the thus formed travelling wave shed, weft carriers 22 are disposed (FIG. 3).

The weft carriers 22 are also schematically indicated in FIG. 2 travelling through the travelling-wave shed formed by the warp yarns 6 which are acted upon by the heddles 5 to provide a travelling-wave shed as illustrated schematicall in FIG. 2.

In FIG. 8, the shafts 15 are connected by angles 17 and a rod 16*a* to heddle shafts 4*a* and 4*b* of the row of heddle shafts 4, the latter occupying during a part of the operation the positions shown by the dashes in FIG. 9, these dashes representing, for example, the positions of the eyes of the heddles, with FIG. 9 also showing the locations of the particular heddle shafts 4*a* and 4*b* of FIG. 8. The positions of the heddle shafts 3 are indicated by the small circles in FIG. 9, these circles representing, for example, also the eyes of the heddles connected with the shafts 3, and the shafts 3 will occupy the position shown in FIG. 9 when the shafts 4 occupy the position shown in FIG. 9. As is apparent from FIG. 8 the shaft 14 is connected through a rod 16*a* with the corresponding heddle shafts 3*a* and 3*b* which are also indicated in FIG. 9.

However, in FIGS. 10 and 11 which schematically illustrate the structure according to the same scheme as FIGS. 8 and 9, it will be seen that the shaft 14 is connected by way of member 17*a* to a rod 16*b* which is fixed to the shafts 4*c* and 4*d* of the row of shafts 4, while through member 17*b* the shaft 15 is connected through another rod 16*b* with the heddle shafts 3*c* and 3*d,* the positions of the latter shafts or heddle eyes connected therewith being shown schematically in FIG. 11. Thus an additional heddle shaft in line with one row of heddle shafts may be connected to the corresponding in-phase heddle shafts of the same row or of the other row.

It will be noted from FIG. 2 that the weft-carriers 22 are schematically illustrated therein as they move through the travelling-wave shed which is shown schematically in FIG. 2 and which is formed by the warp yarns 6 as a result of the movement of the heddle shafts and heddles connected therewith.

The proposed shedding mechanism operates as follows.

As the shaft 8 rotates, the cams 7 impart reciprocating alternate motion to the collars 9. The latter cause the levers 10 to rock thereby transmitting reciprocating alternate motion via the connecting rods to the heddle shafts 3 and 4 with the heddles 5 for the warp ends 6 forming the travelling-wave shed wherethrough the weft carreirs are being propelled.

The additional heddle shafts 14 and 15 installed in the spacing between the drive sections 1 and 2 in guides 13 are actuated by the cophasal main heddle shafts through the rods 16 or the links 19.

What is claimed is:

1. In a fabric-weaving apparatus, at least a pair of systems of main heddle shafts respectively carrying heddles for receiving warp yarns, a pair of drive means respectively connected operatively with said systems of main heddle shafts for operating the latter to participate in the formation of travelling-wave sheds formed by the warp yarns, each system of main heddle shafts and drive means operatively connected thereto forming in itself part of a travelling-wave loom for weaving a fabric of a given width, said systems of main heddle shafts and said pair of drive means respectively connected operatively therewith being situated adjacent but spaced slightly from each other with at least the two adjacent heddles of the two systems of main heddle shafts in line with each other, so that a given space is formed between the pair of systems of main heddle shafts, at least one additional heddle shaft situated in the latter space, and means connecting said additional heddle shaft to at least one of said main heddle shafts of one of said systems for transmitting movement from the latter one main heddle shaft to said additional heddle shaft for operating the latter for participating in the weaving of a fabric having a width greater than the sum of the widths of the fabrics woven by both of said looms.

2. The combination of claim 1 and wherein said means connecting said additional heddle shaft to said one main heddle shaft couples the latter shafts rigidly to each other.

3. The combination of claim 1 and wherein said means connecting said additional heddle shaft to said one main heddle shaft includes an elongated rod pivotally connected with said additional heddle shaft.

4. The combination of claim 1 and wherein said means connecting said additional heddle shaft to said one main heddle shaft also connects said additional heddle shaft to a main heddle shaft of the other of said systems.

5. The combination of claim 1 and wherein the main heddle shafts of each system are arranged in two rows, at least a pair of said additional heddle shafts being situated in said space in line with said rows of main shafts of said systems, and a pair of said means connecting said additional heddle shafts respectively with a pair of said main heddle shafts for transmitting movement from the latter to said additional heddle shafts for operating the latter to participate in the formation of said fabric.

6. The combination of claim 5 and wherein said pair of means respectively connect said additional heddle shafts with main heddle shafts which are situated respectively in rows which are in line with said additional heddle shafts.

7. The combination of claim 5 and wherein said pair of means connect said additional heddle shafts respectively to said main heddle shafts situated in rows which are not in line with said additional heddle shafts.

* * * * *